United States Patent [19]

Schwartz et al.

[11] 4,218,949

[45] Aug. 26, 1980

[54] MASTER CONTROL LSI CHIP

[75] Inventors: Harold O. Schwartz, Elburn; Dennis E. Kidd, Sycamore, both of Ill.

[73] Assignee: The Wurlitzer Company, DeKalb, Ill.

[21] Appl. No.: 917,311

[22] Filed: Jun. 20, 1978

[51] Int. Cl.[2] ..... G10H 1/02

[52] U.S. Cl. ..... 84/1.03; 84/1.24; 84/DIG. 12; 84/DIG. 22; 84/DIG. 23

[58] Field of Search ..... 84/1.01, 1.03, 1.24, 84/DIG. 12, DIG. 22, DIG. 23

[56] References Cited

U.S. PATENT DOCUMENTS

| | | | |
|---|---|---|---|
| 3,585,891 | 5/1969 | Schwartz | 84/1.03 |
| 3,763,305 | 10/1973 | Nakada | 84/1.03 |
| 3,840,691 | 10/1974 | Okamoto | 84/DIG. 12 |
| 3,902,393 | 9/1975 | Machanian | 84/1.03 |
| 3,918,341 | 11/1975 | Bunger | 84/DIG. 12 |
| 3,972,258 | 8/1976 | Adachi | 84/DIG. 12 |
| 4,010,667 | 3/1977 | Kniepkamp | 84/1.03 |
| 4,062,263 | 12/1977 | Yamaga | 84/1.01 |
| 4,116,102 | 9/1978 | Tsunoo | 84/1.01 |
| 4,129,055 | 12/1978 | Whittington et al. | 84/1.01 |
| 4,135,423 | 1/1979 | Gross | 84/1.03 |
| 4,144,787 | 3/1979 | Robinson et al. | 84/1.01 |
| 4,147,085 | 4/1979 | Robinson | 84/1.01 |
| 4,148,241 | 4/1979 | Morez et al. | 84/1.24 |
| 4,154,132 | 5/1979 | Mishima | 84/1.03 |
| 4,163,407 | 8/1979 | Solender | 84/1.03 |

*Primary Examiner*—J. V. Truhe
*Assistant Examiner*—William L. Feeney
*Attorney, Agent, or Firm*—Trexler, Wolters, Bushnell & Fosse, Ltd.

[57] ABSTRACT

In an electronic organ or the like constructed of a plurality of large scale integrated circuit (LSI) chips, the present disclosure relates to a master control LSI chip having a counter providing multiplexing drive outputs and also having a read only memory (ROM) programmed to provide rhythm voice patterns.

15 Claims, 3 Drawing Figures

MASTER CONTROL LSI CHIP

BACKGROUND OF THE INVENTION

Electronic organs have been known for many years. Early electronic organs used various electro-mechanical devices for generating electrical oscillations corresponding to musical tones. Various types of electronic oscillators have been used to provide such oscillations. Some organs have used an independent oscillator for each tone. This is an expensive construction, and for cost saving reasons it has been common practice to provide twelve oscillators to provide the semitones of the top octave, and to use divide-by-two circuits to provide the tones in lower octaves. More recently it has become well known to use a single radio frequency oscillator with divider circuits of different divider ratios to produce the top octave of tones. This system is sometimes known as a top octave synthesizer (TOS). Strings of divide-by-two circuits have been used to provide the notes in lower octaves of the organ.

With the advent of reliable large scale integrated circuit (LSI) chips efforts have been made to construct electronic organs utilizing digital circuits. It is relatively easy to construct LSI chips that utilize digital circuits whereas it is relatively difficult to provide analog circuits with such LSI chips.

OBJECTS AND BRIEF DISCLOSURE OF THE PRESENT INVENTION

It is an object of the present invention to provide, in an electronic organ constructed on digital principles, a large scale integrated circuit (LSI) chip which functions as a master control chip providing control information to a multiplexer for the keyboard and related switches.

It is yet another object of the present invention to provide an LSI master control chip for use in an electronic organ, which chip has a read only memory (ROM) having rhythm patterns stored therein to control rhythm accompaniment in the organ.

In carrying out the foregoing and other objects an LSI chip is provided with a main counter comprising a data clock and a string of different division ratios whereby to develop a plurality of multiplex control signals, and also other useful frequencies. The present LSI chip also has a read only memory (ROM) which has a plurality of rhythm tracks thereon. By way of specific example there are five rhythm patterns each containing at least twenty-four words. These rhythm patterns may be programmed into any combination of tracks (track being defined as a column of the ROM, i.e, the Nth bit of each word). There are seventy-nine such tracks that can be individually assigned to any rhythm pattern and any rhythm element on either or neither of two halves of a forty-eight count total cycle. Therefore, any track can be used as desired.

DESCRIPTION OF THE DRAWINGS

The foregoing and other objects and structure of the present invention will best be understood from the following drawings when taken in connection with the corresponding portion of the specification wherein.

DETAILED DISCLOSURE

Figure 1:
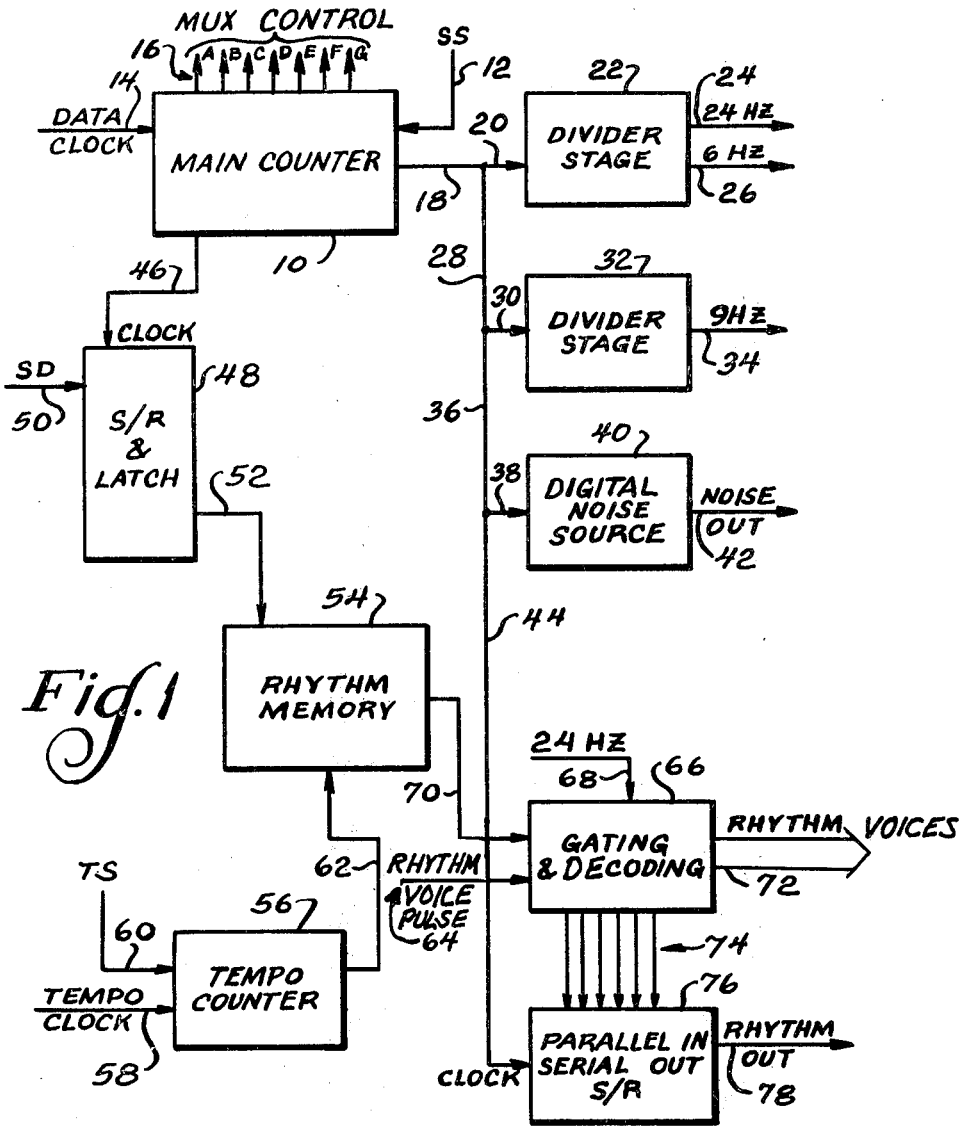
FIG. 1 is a block diagram illustrating the present invention.

Turning now to the drawings in greater particularity, and first to FIG. 1, there will be seen a main counter 10 having a system strobe input 12 and a data clock input 14. The data clock input 14 is connected to the output of a data clock (not shown) having a nominal 106 KHz output frequency and rectangular wave digital waveform. The main counter has seven multiplex control outputs 16, respectively labeled as A through G. These outputs are connected to an external multiplexer, not shown herein. However, the connection just referred to as well as other connections of the circuits shown herein as FIG. 1 are incorporated on a single LSI chip which comprises the A-1 chip shown as part of an organ system as disclosed in the copending application of Harold O. Schwartz, Dennis E. Kidd, and William R. Hoskinson, filed June 20, 1978 under Ser. No. 917,300 assigned to the same assignee as the present application, namely The Wurlitzer Company of DeKalb, Illinois.

The main counter 10 also has an output at 18 serving as an input 20 to a divider stage 22. The divider stage 22 has an output 24 comprising a rectangular waveform of 24 Hz. The divider stage 22 has another output 26 having a substantially 50% duty cycle rectangular wave of 6 Hz, which will be recognized as a vibrato frequency commonly used in electronic organs and the like.

A branch conductor 28 from the main counter output 18 leads to an input 30 of a divider stage 32 having a rectangular wave output 34 at 9 Hz. Another branch conductor 36 leads from the branch 28 to an input 38 to a digital noise source 40 having a noise output at 42. Digital noise sources are known in the art, and this particular digital noise source may be the functional equivalent of National Semiconductor chip MM 5837. There is another branch conductor 44 leading from the branch conductor 36, and more will be said of this shortly hereinafter.

The main counter 10 has an output conductor 46 leading to a clock input of a shift register and latch 48. The shift register and latch 48 has an input 50 comprising serial data obtained from the external multiplexer controlled by the multiplex outputs 16 of the main counter 10. An output 52 from the shift register and latch 48 leads to a rhythm memory 54. More will be said about both the shift register and latch 48 and the rhythm memory 54 shortly hereinafter.

The LSI chip of FIG. 1 also includes a tempo counter 56 having a tempo clock input 58. This tempo clock input operates in the range of 5 to 50 Hz and is user adjustable. The waveform is a rectangular waveform. The tempo counter also has a tempo strobe or synchronization (TS) input at 60 to insure synchronization of tempo counters if a plurality of chips of the type under consideration is operated together as disclosed in the aforesaid application of Schwartz, Kidd and Hoskinson.

The tempo counter 56 has an output 62 leading to the rhythm memory; this output is the binary code which addresses the memory locations. The gating and decoding circuit 66 has an input 64 labeled rhythm voice pulse. This input gates on rhythm voices 72 for a predetermined time. This gating and decoding circuit has another input 68 of 24 Hz. This 24 Hz can be gated on to one of the rhythm voices 72, e.g., to simulate a drum roll. The gating and decoding circuit 66 has an input of several parallel lines 70. This input is from the rhythm memory and contains the binary information which is addressed by the tempo counter on line 62.

The gating and decoding circuit 66 has an output of several parallel lines 72 of rhythm voices, and further has an output of several parallel lines 74 to a parallel in-serial out shift register 76. The shift register 76 also receives a clock input from the line 44 previously mentioned. The shift register 76 also has a serial output 78 containing rhythm information.

Figure 2:
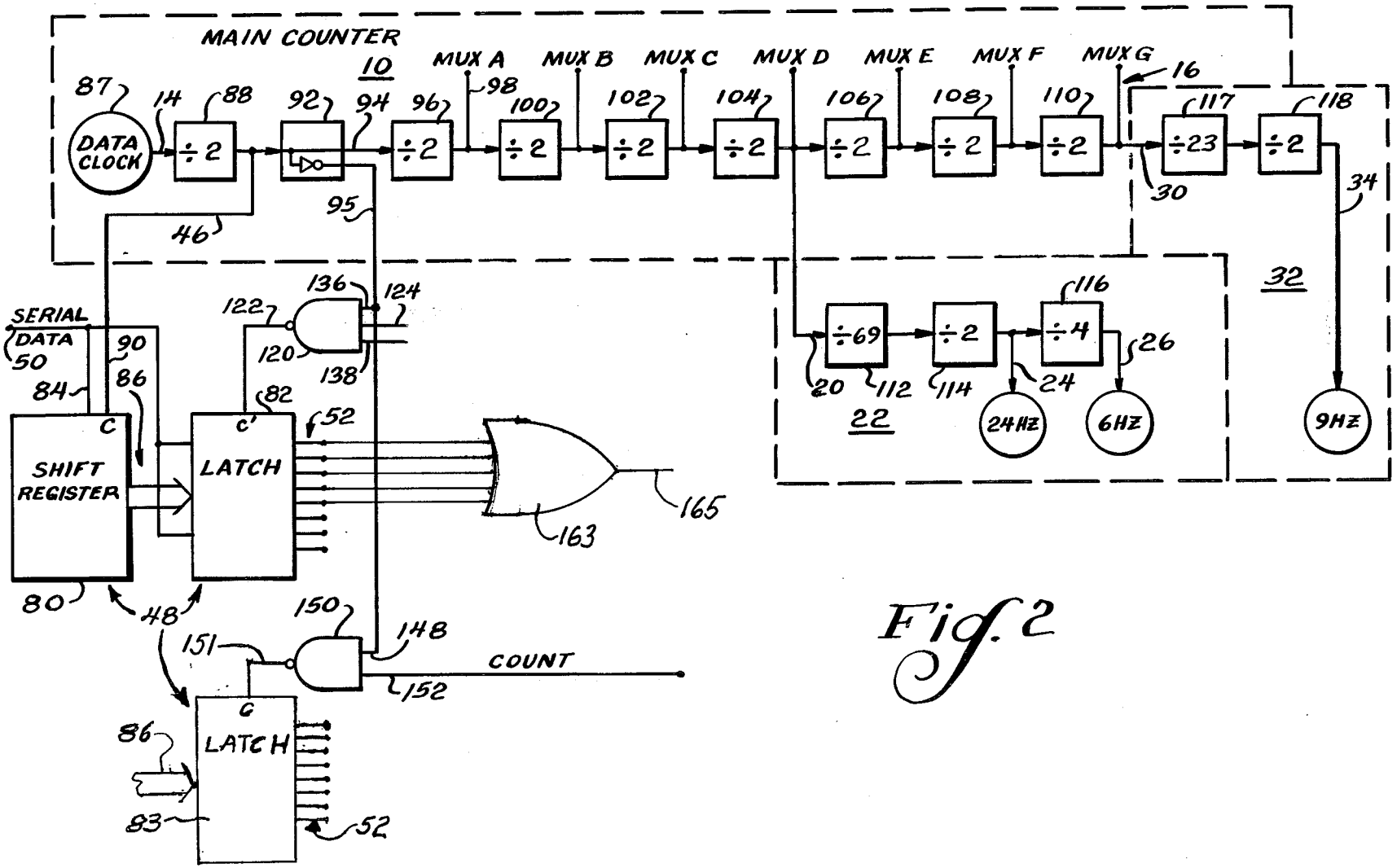
FIG. 2 is a block diagram showing a portion of FIG. 1 in greater detail.

With reference to FIG. 2 it will be seen that the shift register and latch combination 48 of FIG. 1 comprises a separate shift register 80 and two latches 82 and 83. The serial data line 50 has an input 84 to shift register 80. The shift register 80 converts the serial data into parallel information fed by parallel conductors 86 into the latches 82 and 83. Output connections for the latch comprise parallel conductors, previously identified as the line 52 and so numbered in FIG. 2. The main counter 10 will be seen to include the data clock input connection 14 from an external data clock 87. The data clock input 14 goes to a first divide-by-two stage 88 which supplies output to the line 46 leading to the clock input of the shift register at 90. The output from the first divide-by-two stage 88 leads through a stage 92 having an in phase output 94 and a 180 degree phase output 95. The output 94 goes to a divide-by-two stage 96 from which the multiplex A driver output is taken at 98. Successive stages of divide-by-two nature follow the stage 96 and are respectively numbered 100, 102, 104, 106, and 110. The outputs of these successive stages are the multiplex drivers previously numbered 16 in FIG. 1 and leading to the respective connections of the external multiplexer.

The output 20 is taken following the divide-by-two stage 104 and leads to the divider stage 22. This divider stage has first a divide-by-sixty-nine sub-stage 112 leading to successive sub-stages 114 and 116, respectively dividing by two and by four. The 24 Hz output 24 is taken as the output of the divide-by-two sub-stage 114, while the 6 Hz output 26 is taken as the output of the divide-by-four sub-stage 116.

The connector 30 leading to the divider stage 32 is connected to a sub-stage 117 which divides by twenty-three. The output of the sub-stage 116 leads to a sub-stage 118 which is a divide-by-two circuit and which provides the 9 Hz output 34.

The inverted output 95 from the stage 91 leads to one input of a 2 input NAND gate 120 having an output 122 leading to the clock input of the latch 82 and causes the latch to accept the data which is present on the parallel conductors 86.

The other input 124 of the NAND gate 120 is pulsed by a specific count of the data clock, which is derived from the main counter 10.

The line 95 leads also to the input 148 of a 2 input NAND gate 150. The other input 152 is pulsed by a specific count of the data clock, which is derived for the main counter 10. The NAND gate 150 has an output 151 which leads to the clock input of the latch 83 and causes the latch to accept the data which is present on the parallel conductors 86.

Before leaving FIG. 2 is should be noted that the system strobe 12 of FIG. 1 has not been shown in FIG. 2 for clarity of the drawing. However, it is to be understood that the system strobe goes to each of the divide-by-two counters 88 et seq.

Figure 3:
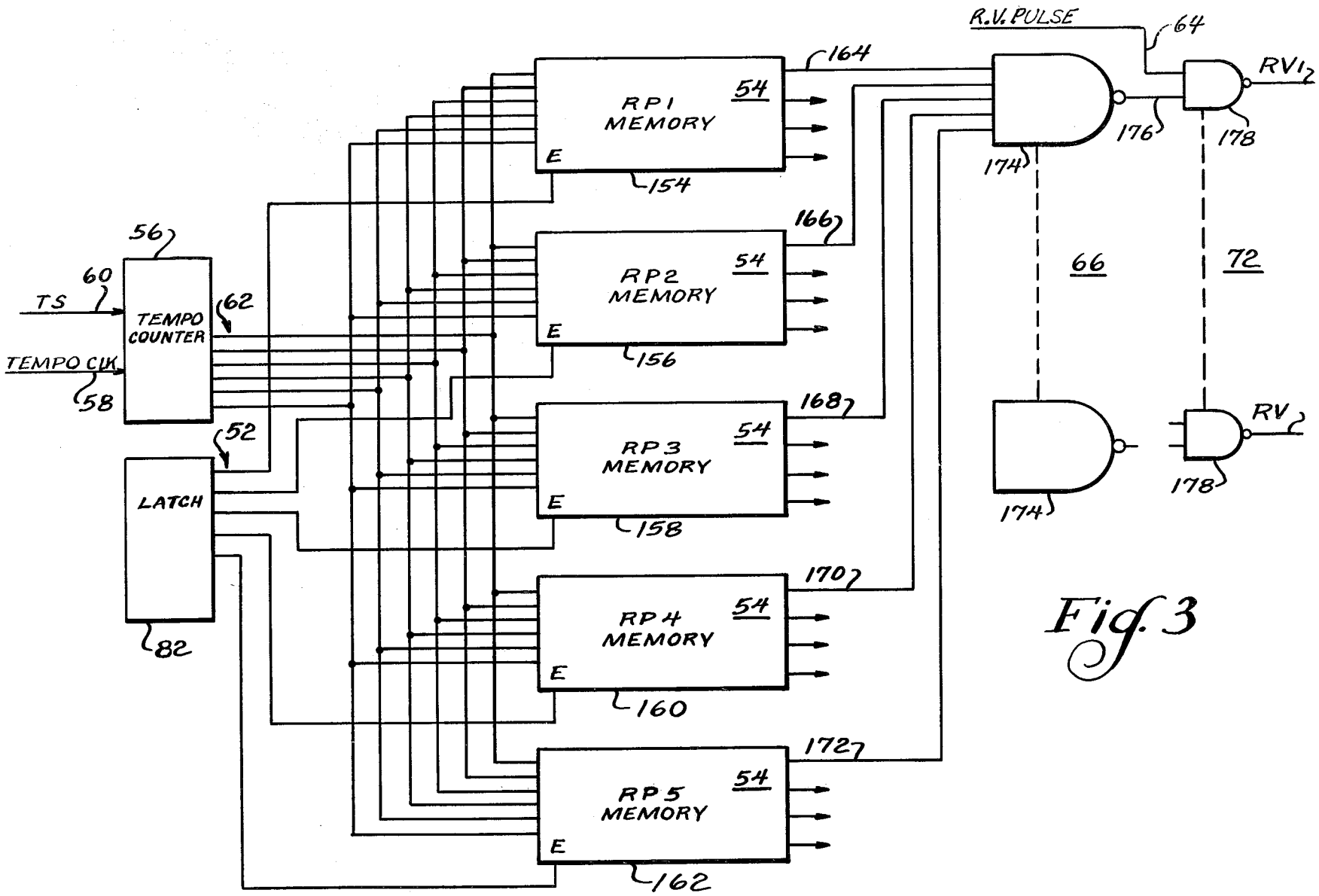
FIG. 3 is another drawing showing a different portion of FIG. 1 in greater detail.

Further explanation of the rhythm memory 54 is taken up with regard to FIG. 3. The memory 54 is one large ROM, but functions as if it were 5 separate smaller ROMS or ROM sections 154, 156, 158, 160, and 162. Two MM 5203's ROMS provide the equivalent of each of the ROM sections 154 et seq, which are provided in the LSI chip along with the other circuits disclosed herein. Each of the memories stores one rhythm pattern, and memory 154 is identified as RP1 memory indicated the first rhythm pattern. Subsequent memories 156 et seq are indicated as RP2 through RP5 being sequential memories for rhythm patterns two through five. As noted heretofore the total memory can have more than five sections whereby a very large number of rhythm patterns can be established. However, for illustrative purposes only the five are shown.

The connection 62 from the tempo counter 56 to the rhythm memory 54 comprises several parallel lines all connected in common to inputs of the memories 54 et seq. in order to permit the addressing of memory locations for a rhythm pattern stored in the rhythm memory. Five of the outputs 52 of the latch 82 are connected individually to the enable or E inputs of the respective memories 154, 156, 158, 160, and 162 and to respective inputs of a five input OR gate 163. The respective memories 154, 156, 158, 160, and 162 each have several binary outputs 164, 166, 168, 170, and 172 connected to the inputs of a plurality of NAND gates 174. The output 176 of each NAND gate 174 is connected to one of the inputs of a respective one of a plurality of two input NAND gates 178. The other input 64 to each NAND gate 178 is the rhythm voice pulse previously mentioned on FIG. 1. Each NAND gate 178 therefore acts as an inverter, each output of which constitutes one of the rhythm elements. A trigger on any of the rhythm voice elements comprises a negative rectangular pulse, and pulses on the appropriate voice such as snare drum, bass drum, bongo, claves, etc.

The data clock 14 identified in connection with FIG. 1 is the data clock which is used for timing purposes in the entire organ. As previously noted the entire organ system is shown in the copending application of Schwartz, Kidd, and Hoskinson. The data clock input 14 acts through the main counter 10 to provide the clock signal on the conductor 46 to the shift register and latch. The main counter 10 in conjunction with the data clock input 14 provides multiplex driving or control signals on the lines 16 leading to the external multiplexer, the latter being a part of the system disclosed and claimed in the aforesaid copending application of Schwartz, Kidd, and Hoskinson. The multiplexed information comprises serial data to the organ as to which keys are depressed, and which notes the organ therefore should play. In addition, the multiplexing system provides more serial data as to which rhythm switches have been manipulated by the player, and this serial data is at 50 in FIGS. 1 and 2, being supplied through the shift register and latches 48.

The input connection at 122 to the clock input of the latch 82 (FIG. 2) from the various stages of the main counter 10 latches the demultiplexed information from the shift register 80 at a predetermined time.

The shift register is a multiple bit device as are the latches 82 and 83 and information is transferred bit for bit into the latches from the shift register.

Each of the ROM sections 154, 156, 158, 160, and 162 (FIG. 3) of the ROM 54 comprises 48 words and 16 bits. The latch 82 and tempo counter 56 are used to access the memory locations. The information read out of the memories is gated and decoded in the NAND gates 174 and 178, comprising the functioning parts of the gating and decoding device shown in FIG. 1 as 66. Additional information is transmitted from the parallel in-serial out shift register 76 at 78 as a rhythm output to provide information to another chip (the A-2 chip in the aforesaid Schwartz, Kidd, and Hoskinson copending application) as to bass and chording.

Most of the rhythm voices out at 72 in FIG. 1 and FIG. 3 comprise pulses to turn on or to gate the output of various sounds of rhythm. However, the 24 Hz output at 24 is also an input at 68 to the gating and decoding circuits 66 whereby one of the rhythm voices out can be repetitively pulsed at a 24 Hz rate rather than a single pulse. This 24 cycle frequency is used at appropriate times to gate the snare drum sound as a snare roll. The noise output is gated externally of the chip by one or more of the rhythm voice outputs to provide a brush cymbal sound.

Certain of the multiplex control outputs 16 (Mux A–Mux G) are used for additional purposes. The data clock frequency of 106 KHz has been chosen for this purpose. Thus, the Mux E output is 1656 Hz, the Mux F output is 828 Hz, and the Mux G output is 414 Hz. External JK flip-flops connected to the Mux G output produce further divider frequencies of 207 and 103.5 Hz. The 103.5 Hz is used for the bass drum, and the 207 Hz for the snare drum. The 1656 Hz, the 828 Hz, the 414 Hz outputs just mentioned are used for other rhythm sounds.

The chip embodying the present invention uses a system strobe (not shown). This is a logic level I/O that is used to reset the main counter 10 at count zero, based on a 128 count cycle. "System Strobe" is used in the overall organ system to reset all the main counters and maintain synchronization. "Tempo Synchronization" 60 (TS in FIG. 3) is a logic level I/O used to control rhythm ROM counter synchronization in all like (A-1) chips used in the organ system. A pulse from V+ to ground will occur at this pin at count 0 of the rhythm counter, based on the 48 count cycle.

The output 165 of OR gate 163 is termed "Rhythm On" and is used to enable the tempo counter 56 on the chip as well as any other A-1 chip in the system. The "Tempo Clock" 58 accepts an external rectangular wave with a frequency in the range of 5 to 50 Hz. This frequency is user controllable to determine the speed or rate at which the rhythm plays.

An external interconnection is used to output the chord and bass trigger information from the present chip to the A-2 chip identified in the system as disclosed in the copending application of Schwartz, Kidd, and Hoskinson previously noted. The present chip also has a "Chip Enable" pin. This pin is used to enable, or disable, the seven rhythm voice outputs and the serial transfer of data, the chord and bass information just noted, known as rhythm out. When the "Chip Enable" is held at a logic 0 it enables these; while at logic 1 it disables them.

The circuits shown may be embodied either using separate integrated circuits connected in the manner shown or a single integrated circuit incorporating all of the elements shown. Such an integrated circuit may be fabricated using process techniques well known in the semiconductor industry, desirably in metal oxide silicon (MOS) form. Since such techniques do not form a part of this invention, they will not be described in further detail.

The particular example of the present invention as shown and described herein will be understood as exemplary. Various changes will no doubt occur to those skilled in the art and are to be understood as forming a part of the present invention insofar as they fall within the spirit and scope of the appended claims.

The invention is claimed as follows:

1. In an electronic organ or the like having a plurality of switches and manually engagable means for operating said switches, multiplexing means operable in conjunction with said switches to provide serial data as to the condition of said switches, a data clock, and a large scale integrated circuit control chip comprising a first counter operated by said data clock, said counter providing drive signals for said multiplexing means, a memory having a plurality of rhythm patterns stored therein, means for receiving said serial data and for selectively latching said data, a second counter operated by a second external clock, means interconnecting said memory with said latching means and with said second counter for accessing said memory, means connected with said data clock for gating the information accessed from said memory out of said chip, and further means connected with said first counter for separately gating the information accessed from said memory out of said chip.

2. The combination as set forth in claim 1 wherein said means for receiving said serial data and for selectively latching said data comprises means for first converting said serial data to parallel data, and then latching said data in parallel.

3. The combination as set forth in claim 2 wherein the means for converting said serial information to parallel information comprises a shift register.

4. The combination as set forth in claim 1 and further comprising means interconnected with said first counter for providing frequency useful for other purposes in said organ.

5. The combination as set forth in claim 1 and further including a digital noise source on said chip operated by said data clock.

6. The combination as set forth in claim 1 wherein one of the means for gating information out of said chip comprises means for providing information as to bass and chording and means transferring said information out of said chip.

7. The combination as set forth in claim 1 wherein one of the means for gating information out of said chip comprises means for encoding information as to bass and chording and for transferring such information serially from said chip.

8. The combination as set forth in claim 7 wherein the means for transferring information serially from said chip includes a parallel in-serial out shift register.

9. A large scale integrated circuit chip comprising means for receiving serial data from an external multiplexing means and for converting it to parallel data, means for latching said parallel data at predetermined times, a main counter adapted to receive input from a data clock, said main counter having output means for driving said external multiplexing means, a memory having a plurality of rhythm patterns stored therein, a second counter having means for receiving a clock input for operating said second counter, means interconnecting said rhythm memory with said latch and with said second counter for accessing said memory, means interconnecting said main counter and said latch for latching information at predetermined times determined by said main counter, and means for decoding the information from said memory and for gating the decoded information from said chip.

10. A large scale integrated circuit chip as set forth in claim 9 and further including means interconnected with said gating means for producing serial rhythm information and for sending such information out of said chip.

11. An integrated circuit chip as set forth in claim 9 and further including a digital noise source and at least one divider stage interconnected with said main counter for providing useful frequencies, and means for transferring the outputs of said digital noise source and of said divider stage out of said chip.

12. An integrated circuit chip as set forth in claim 10 and further including a digital noise source and at least one divider stage interconnected with said main counter for providing useful frequencies, and means for transferring the output of said digital noise source and of said divider stage out of said chip.

13. In an electronic organ or the like having a plurality of switches and manually engagable means for operating said switches, multiplexing means operable in conjunction with said switches to provide serial data as to the condition of said switches, a data clock, a tempo clock, and a plurality of large scale integrated circuit chips each comprising a first counter operated by said data clock, said first counter of at least one of said chips providing drive signals for said multiplexing means, a memory having a plurality of rhythm patterns stored therein, means for receiving said serial data and for selectively latching said data, a second counter operated by said tempo clock, means interconnecting said memory with said latching means and with said second counter for accessing said memory, means for gating the information accessed from said memory out of each said chip, and external means interconnecting said chips for conjoint operation thereof, said interconnecting means including means for synchronizing the operation of said chips.

14. The combination as set forth in claim 13 wherein the means for synchronizing operation of said chips comprises a system strobe for synchronizing said chips with all operating parts of said organ, and a tempo strobe for operating the tempo counters in all of said like chips in synchronism.

15. The combination as set forth in claim 13 wherein the means synchronizing the operation of said chips comprises means for simultaneously enabling said second counter means in each of said plurality of interconnected chips.

* * * * *